US010667575B2

(12) United States Patent
Smith et al.

(10) Patent No.: US 10,667,575 B2
(45) Date of Patent: Jun. 2, 2020

(54) ROTATABLE SOLE ASSEMBLY

(71) Applicant: SATRA Technology Centre Limited, Northamptonshire (GB)

(72) Inventors: David Roger Smith, Northamptonshire (GB); Thomas John William Bayes, Northamptonshire (GB); Philip David Muirhead, Lincolnshire (GB)

(73) Assignee: SATRA TECHNOLOGY CENTRE LIMITED, Northamptonshire (GB)

( * ) Notice: Subject to any disclaimer, the term of this patent is extended or adjusted under 35 U.S.C. 154(b) by 198 days.

(21) Appl. No.: 15/573,160

(22) PCT Filed: May 11, 2016

(86) PCT No.: PCT/GB2016/051342
§ 371 (c)(1),
(2) Date: Nov. 10, 2017

(87) PCT Pub. No.: WO2016/181133
PCT Pub. Date: Nov. 17, 2016

(65) Prior Publication Data

US 2018/0125161 A1 May 10, 2018

(30) Foreign Application Priority Data

May 13, 2015 (GB) ..... 1508120.1

(51) Int. Cl.
*A43B 13/14* (2006.01)
*A43B 3/00* (2006.01)

(52) U.S. Cl.
CPC ..... *A43B 13/14* (2013.01); *A43B 3/0042* (2013.01)

(58) Field of Classification Search
CPC ..... A43B 13/14; A43B 3/0042
See application file for complete search history.

(56) References Cited

U.S. PATENT DOCUMENTS 3,081,562 A 3/1963 Oakley
3,181,254 A * 5/1965 Cowen ..... A43B 21/433 36/39

(Continued)

FOREIGN PATENT DOCUMENTS

GB 239319 A 9/1925
GB 1464628 A 2/1977

(Continued)

OTHER PUBLICATIONS

International Search Report and Written Opinion dated Jul. 13, 2016 for International Patent Application No. PCT/GB2016/051342.

(Continued)

*Primary Examiner* — Ted Kavanaugh
(74) *Attorney, Agent, or Firm* — Traolli, Sundheim, Covell & Tummino LLP

(57) ABSTRACT

We disclose herein a rotatable sole assembly for a shoe which comprises a first plate (305), a second plate (320); and a coating layer (330) between the first and second plates. The coating layer (330) is configured to rotate one of the first and second plates with respect to the other of the first and second plates. The sole assembly is designed to reduce ACL injuries as well as the incidence of other lower leg injuries related to high torque forces.

14 Claims, 10 Drawing Sheets

(56) References Cited

U.S. PATENT DOCUMENTS

| | | | | | |
|---|---|---|---|---|---|
| 3,680,231 | A * | 8/1972 | Dymond | A43B 3/0042 | 36/59 R |
| 4,271,610 | A * | 6/1981 | Parrent | A43B 5/12 | 36/136 |
| 5,682,689 | A * | 11/1997 | Walker | A43B 3/0042 | 36/134 |
| 5,918,384 | A | 7/1999 | Meschan | | |
| 2004/0055181 | A1* | 3/2004 | Gallegos | A43B 3/0042 | 36/103 |
| 2008/0022562 | A1* | 1/2008 | Manis | A43B 13/26 | 36/59 R |
| 2009/0113761 | A1* | 5/2009 | Goldberg | A43B 3/0042 | 36/103 |
| 2010/0311514 | A1* | 12/2010 | Antolick | A43B 3/0042 | 473/217 |

FOREIGN PATENT DOCUMENTS

| | | | |
|---|---|---|---|
| GB | 2492587 | A | 1/2013 |
| WO | 9312682 | A | 7/1993 |

OTHER PUBLICATIONS

UK Search Report dated Nov. 16, 2015 for corresponding GB Application No. 1508120.1.

* cited by examiner

ROTATABLE SOLE ASSEMBLY

FIELD OF THE INVENTION

This invention relates to a rotatable sole for a shoe, particularly but not exclusively, to a rotatable midsole attachable to a shoe.

BACKGROUND TO THE INVENTION

Many sports, such as soccer, rugby, basketball, baseball and tennis, amongst others, require the athlete to frequently change direction. This can cause significant stress to muscles, ligaments and tendons which can cause injuries over time. It is not uncommon for athletes to also suffer more traumatic injuries as a result of twisting an ankle beyond its normal range of movement.

A number of sports, such as soccer, golf, rugby, sprinting and cross country, amongst others, utilise footwear having spikes, studs or other means of improving traction. Properly fitting sports shoes do not allow the foot to substantially move within the shoe. This is essential to prevent minor injuries such as blisters which can negatively affect performance but can increase the risk of occurrence of more severe injuries due to increased traction related to spikes becoming embedded in the ground.

Treatment for lower limb injuries usually consists of applying a compression bandage to the injured area and resting. For many people, complete rest is not possible as they may need to work or they may have children to look after. It is often just not convenient to rest for long periods of time in order to recover from injury. Therefore, it is not uncommon for lower limb injuries to cause recurring pain and suffering due to more damage being caused by simply carrying on with normal life.

Several attempts have been made to provide solutions to the problems above. For example, WO2007044451, GB2264627, GB2425706 and US2010/0311514 describe various solutions. However, most of these documents use mechanical metal joints, bearings and/or pivots for facilitating rotations of a shoe. Such mechanical metal components add a significant amount of weight to the shoe. These components can also be dangerous in a situation if they were to come through from the sole to the main body of the shoe. Further, in the prior art, the rotation mechanism needs to be integrated with the shoe and hence it has to be made at the same time of manufacturing as the shoe. This reduces flexibility and increases manufacturing costs. The mechanical metal rotation mechanism also does not adequately reduce torque through the front end portion of the shoe.

It is an aim of the present invention to address the problems discussed above.

SUMMARY

According to one aspect of the present invention there is provided a rotatable sole assembly for a shoe, the sole assembly comprising:

a first plate;

a second plate; and a coating layer between the first and second plates;

wherein the coating layer is configured to rotate one of the first and second plates with respect to the other of the first and second plates.

According to a further aspect of the present invention there is provided a rotatable sole assembly for a shoe, the sole assembly comprising:

a first plastic plate;

a second plastic plate; and wherein the sole assembly is configured to rotate one of the first and second plastic plates with respect to the other of the first and second plastic plates.

In one embodiment, the plastic plates can be made from a nylon material impregnated with an oil, or molybdenum sulphide then the sole assembly mechanism still functions as intended. In such a case, the coating layer is formed or produced from the nylon material or molybdenum sulphide material.

The sole assembly may be a midsole assembly which is coupled to a front end portion of the shoe and an outer sole portion of the shoe. The coating layer may comprise a lubricant material. The lubricant material may comprise graphite powder. Alternatively, the coating layer may be produced or released from the first and second plates as discussed above.

It would be appreciated that the term "coating layer" covers both a discrete layer provided between the first and second plates (e.g. graphite powder) and a layer formed or produced from the first and second plates (e.g. when the nylon material or molybdenum sulphide material is used as the plates). It is intended that a slippery effect is provided and/or produced between the plates by means of the coating layer.

Whilst the prior art shoes mainly use metal (mechanical) joints and/or pivots to facilitate the rotation of the sole, the sole assembly above does not need any metal joints and/or pivots. It simply uses plates, for example, plastic plates which are attached to the respective sole slabs. There is a coating layer formed between the plates, which ensures that each part of the sole assembly is rotatable with respect to one another. Furthermore, the sole assembly may also include an elastic material holding the both parts of the sole assembly. The elastic modulus (stiffness/elasticity) of this material controls the rotation of the sole assembly. This material ensures that the assembly returns to the original position after the rotation. Since there are no metal joints, bearings or pivots being used in the sole assembly, it is very easy and cost effective to manufacture. Further, it has significantly less weight compared to the prior art soles. It also reduces the risk of any injury if the metal joints/mechanism were to come through the body of the shoe. The proposed sole assembly is designed to reduce the overall torque experienced in the knee of an athlete or service personnel, or to assist the aged, infirm or disabled with general mobility, and to ultimately avoid high levels that could cause or exacerbate injury. The invention is also designed to reduce Anterior Cruciate Ligament (ACL) injuries.

Furthermore, it would be appreciated that the invention relates to a midsole which is attached between the front part of a shoe body and an outer front sole of the shoe. Thus the midsole does not have to be manufactured at the same time of manufacturing a shoe. It can be manufactured as a separate mechanism and then can be installed to any existing/host shoes. It can be removed from the shoe as necessary and thus the proposed design provides better flexibility to a shoe wearer and/or a shoe manufacturer. The proposed sole assembly can be fitted to any types of shoes, for example, a golf shoe, a cricket shoe, a football shoe, a tennis shoe, a basketball shoe and/or a rugby shoe. The sole assembly should not be only restricted to a sports shoe. It can be equally used in other type shoes as well. For example, it can be used in regular consumer shoes. It can also be used in other applications, e.g. outdoor, personal-protective-equipment (PPE), hiking and military applications.

The first and second plates may comprise a material comprising polyethylene terephthalate. It would be appreciated that other suitable materials can also be used.

The sole assembly may further comprise:

a first slab coupled to the first plate; and a second slab coupled to the second plate, wherein the first and second slabs are formed on sides of the first and second plates which are opposite to the sides of the first and second plates on which the coating layer is formed. The first and second slabs may comprise a material comprising EthylVinylAcetate (EVA). It would be appreciated that other suitable materials can also be used.

In the present specification the terms "first plate" and "upper plate" are interchangeable. The terms "second plate" and "lower plate" are interchangeable. The terms "first slab" and "upper slab" are interchangeable. The terms "second slab" and "lower slab" are interchangeable. The terms "elastic material" and "elastic rand" are also interchangeable.

The first and second plates may each comprise a hole. The sole assembly may further comprise a grommet which fits through the hole of the first and second plates. The grommet may be attached to the plates and slabs using an adhesive material comprising cyanoacrylate. The grommet may be a plastic grommet. The grommet is optionally used to improve the rotation. The grommet is not a metal grommet and thus it does not add in any appreciable weight to the shoe. Furthermore, since the grommet is attached using an adhesive material, it may not operate exactly the same way as a metal/mechanical grommet.

The sole assembly may further comprise an elastic material formed surrounding a perimeter of the plates and slabs. The elastic material may be configured to generate a force which permits each rotatable plate and slab to return to a centrally biased position. The elastic material may comprise an elastic modulus which is controlled to generate the force. The elastic material may be attached to the plates and slabs using an adhesive material comprising cyanoacrylate. The term "elastic modulus" refers to the stiffness and/or the elasticity of the elastic material. When the elastic modulus is high then the stiffness of the elastic material is also high. For a weaker elastic modulus, the stiffness of the elastic material is also weaker.

The principle of the design allows the forepart of a sole of a shoe to rotate in a controlled manner. The movement is not free and is controlled in an elastic way and such returns to its normal position after the footwear leaves the ground. When in contact with the ground, the rotation is resisted such that torque increases with greater rotation. Total rotational freedom is approximately 10-25 degrees either way. The amount of torque can also be modified in the construction.

The first and second slabs may comprise chamfered edges. The first slab may comprise an edge closest to the first plate, the edge of the first slab being inwardly chamfered.

The second slab may comprise an edge closest to the second plate, the edge of the second slab being inwardly chamfered.

The chamfered edges may form a groove in a central portion of a perimeter of the sole assembly.

The elastic material may be fitted in or on the groove. The elastic material may be shaped such that the elastic material holds the slabs and plates together at the perimeter of the sole assembly and the elastic material allows the slabs and plates to rotate relative to one another.

The first plate may comprise a concave shape. The second plate may comprise a convex shape.

The sole assembly may be coupled to the shoe and to an outer sole of the shoe by an adhesive material. The sole assembly may be configured to rotate at an angle of 10° to 25° about a longitudinal axis of the sole assembly. It would be appreciated that the sole assembly may not be coupled to the shoe by an adhesive material. In such a case, it may be configured as a cassette-type assembly, such that the assembly is removable. This would allow for the assembly to be replaced if it became worn, or for sole mechanisms with different torsional resistance to be fitted to the left and right foot respectively. Such a cassette-type assembly would be integral to the footwear, yet modular and removable In embodiments, there is provided a rotatable shoe comprising:

a body portion;

the sole assembly as described above; and an outer sole;

wherein the sole assembly is coupled to a front end portion of the body portion and the sole assembly is coupled to the outer sole.

The sole assembly may be configured to reduce a torque applied to the front end portion of the body portion of the shoe.

The torque applied to the front end portion of the body portion of the shoe may be controlled by an elastic modulus of the elastic material.

The torque applied to the front end portion of the body portion may increase with the increase of the elastic modulus of the elastic material.

According to a further aspect of the present invention there is provided a method of manufacturing a rotatable sole assembly for a shoe, the method comprising:

providing a first plate;

providing a second plate; and providing a coating layer between the first and second plates so that one of the first and second plates rotates with respect to the other of the first and second plates.

The sole assembly may be a midsole assembly which is coupled to a front end portion of the shoe and an outer sole portion of the shoe.

The coating layer may comprise a lubricant material comprising graphite powder.

The method may further comprise forming or releasing the coating layer from the first and second plates.

The method may further comprise:

providing a first slab on the first plate; and providing a second slab on the second plate, wherein the first and second slabs are provided on sides of the first and second plates which are opposite to the sides of the first and second plates on which the coating layer is formed.

The first and second slabs may comprise a material comprising EthylVinylAcetate (EVA).

The method may further comprise providing a grommet which fits through a hole of the first and second plates.

The method may further comprise attaching the grommet to the plates and slabs using an adhesive material comprising cyanoacrylate.

The method may further comprise cutting inwardly an edge of the first slab, the edge being closest to the first plate.

The method may further comprise cutting inwardly an edge of the second slab, the edge being closest to the second plate.

The method may further comprise forming a groove in a central portion of a perimeter of the sole assembly.

The method may further comprise providing an elastic material in or on the groove.

The method may further comprise providing the elastic material surrounding a perimeter of the plates and slabs.

The method may further comprise attaching the elastic material to the plates and slabs using an adhesive material comprising cyanoacrylate.

The method may further comprise attaching the sole assembly to the shoe and to an outer sole of the shoe by an adhesive material.

According to a further aspect of the present invention, there is provided a method of controlling a torque at a front end portion of a shoe, the shoe comprising a rotatable sole assembly coupled to the shoe, the shoe assembly comprising a first plate, a second plate, a coating layer between the first and second plates; a slab being coupled to each plate and an elastic material surrounding a perimeter of the slabs and plates;

the method comprising rotating one of the first and second plates with respect to the other of the first and second plates so that the torque is reduced at the front end portion of the shoe.

The method may further comprise controlling an elastic modulus of the elastic material to control the torque applied to the front end portion of the shoe.

The torque applied to the front end portion of the body portion may increase with the increase of the elastic modulus of the elastic material.

BRIEF DESCRIPTION OF THE DRAWINGS

The present disclosure will be understood more fully from the detailed description that follows and from the accompanying drawings, which however, should not be taken to limit the invention to the specific embodiments shown, but are for explanation and understanding only.

DETAILED DESCRIPTION OF THE PREFERRED EMBODIMENTS

The rotation (tare) "Torc" mechanism is a midsole component or midsole assembly that can be incorporated into many types of footwear at the time of manufacture. It allows for rotation of the foot relative to the floor whilst still maintaining frictional contact, and buffering the transfer of potentially painful or damaging torque forces to the lower leg of the wearer.

Installation of the mechanism does not alter the weight or feel of the footwear, and adds nothing to the thickness of the host shoe. Generally, the rotation mechanism (or the midsole assembly) is adhered in place on the forepart of the host shoe, with the original outsole (which is sliced off the midsole when it was removed from the host shoe) stuck to the bottom of the mechanism to maintain its slip resistance properties. It allows the wearer to rotate the forepart of their shoe relative to the ground without either compromising slip resistance or transferring potentially damaging torque forces through the leg. It would be appreciated that certain commercial applications can involve fitting the mechanism to a shoe at the time of manufacture, or in some pre-planned manner shortly after construction of the main body of the footwear. The manufacturer wanting to incorporate the mechanism into their footwear can also set aside a piece of outsole material for the purpose, rather than cutting such from a host shoe.

Figure 1:
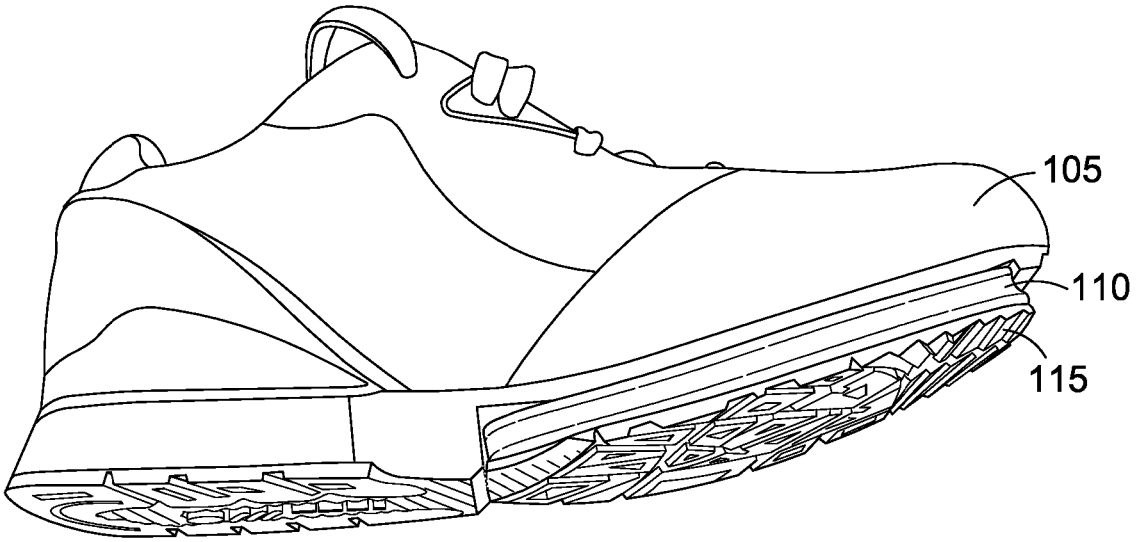
FIG. 1 illustrates a shoe in which a midsole assembly is installed.

FIG. 1 illustrates such a shoe in which a midsole assembly (or the rotation mechanism) is installed. The shoe has a body portion 105 and an outer sole 115 which is cut away from the body portion 105. In one example, the cut away outer sole 115 corresponds to a front end portion of the body portion 105, A wearer toe is generally fitted in the front end portion of the body portion 105. The shoe also includes a midsole assembly 110 fitted between the body portion 105 and the outer sole 115. The midsole assembly 110 is generally attached to the body portion 105 and the outer sole 115 using an adhesive material (glue), for example, cyanoacrylate or superglue.

Figure 2:
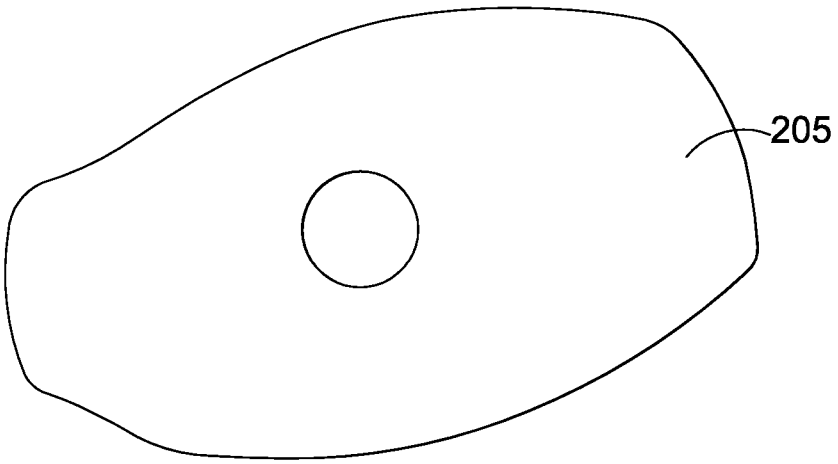
FIG. 2 illustrates a plate of the shoe assembly.
Figure 3:
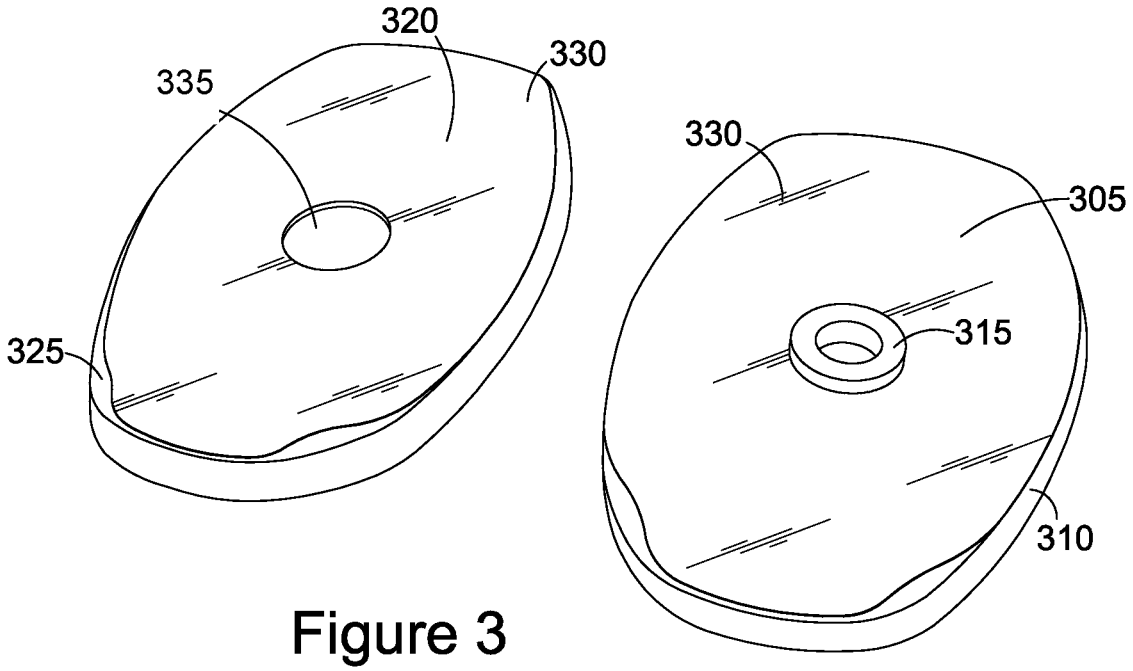
FIG. 3 illustrates a breakdown view of the construction of the midsole assembly.

We will now describe various parts used for the construction of the shoe assembly. At the heart of the midsole assembly ("Torc" mechanism) are two plates, for example, plastic plates, shaped to follow the outline of the forepart of a midsole. Such a plate 205 is shown in FIG. 2. FIG. 3 illustrates a breakdown view of the construction of the midsole assembly. The midsole assembly includes two plates 305, 320. Each plate 305, 320 is adhered to a slab 310, 325 of a typical midsole material, in this case, EthylVinylAcetate (EVA). In embodiments, the two plates 305, 320 rotate against one another, lubricated with a coating of a suitable lubricant 330, for example, graphite powder. The upper plate (or the first plate) 305 in this embodiment is substantially (slightly) concave, and the lower plate (the second plate) 320 is substantially (slightly) convex. This ensures that the plates nest together neatly and that they follow the contour of the outsole of the host shoe (or the shoe having the body portion described in FIG. 1). It would be appreciated that different footwear types will have different sole profiles, so may accordingly use different plate contours. Each plate 305, 320 includes a hole 335 at a central region. The sole assembly includes a grommet 315 which is generally fitted through the holes 335 of the plates 305, 320. The grommet 315 is generally a plastic grommet.

Figure 4:
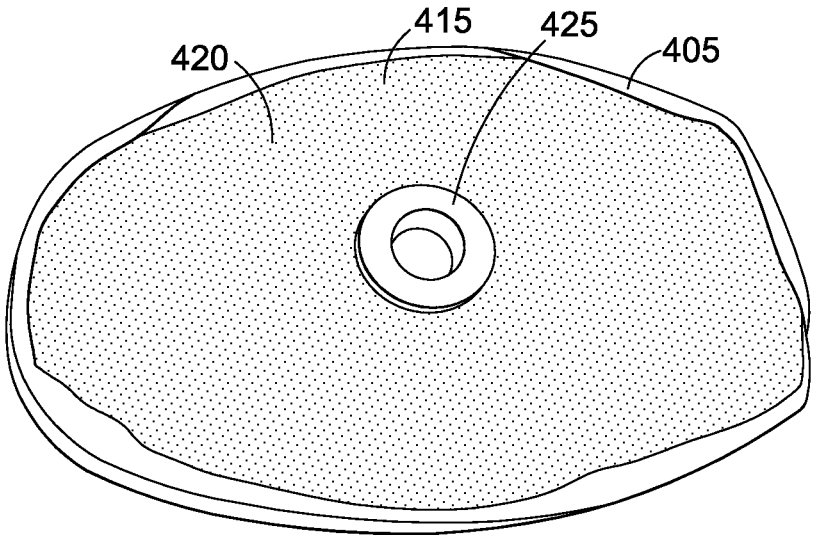
FIG. 4 illustrates an arrangement in which the first plate, the first slab and a grommet are assembled together.

FIG. 4 illustrates an arrangement in which the first plate 415, the first slab 405 and a grommet 425 are assembled together. The coating layer 420 is also provided in this assembly. The coating layer 420 helps to rotate the plates with respect to one another.

In this embodiment, the grommet 425 is adhered to the plastic plate 415 and the first slab 405 using an adhesive material, for example, cyanoacrylate or superglue.

Figure 5:
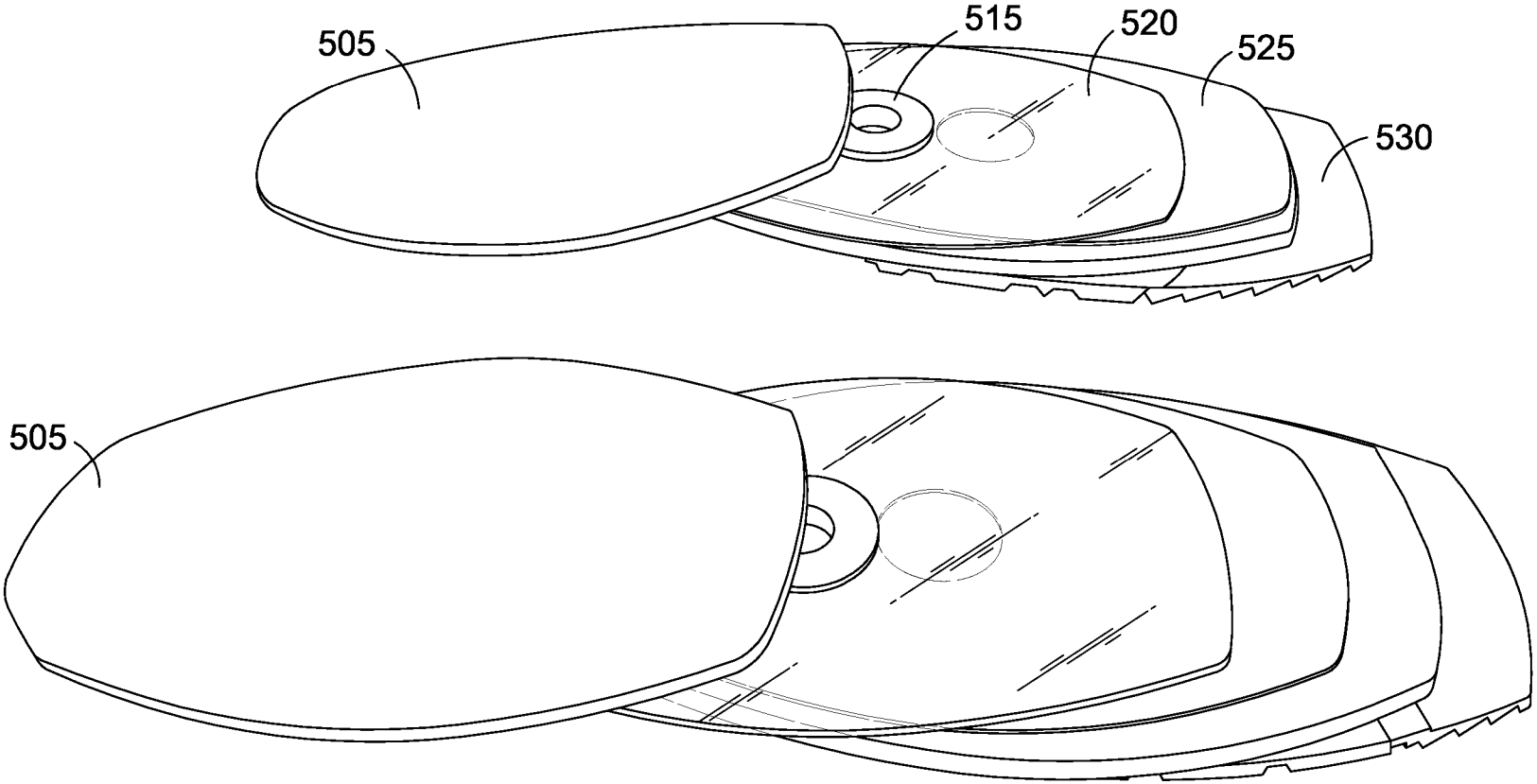
FIG. 5 illustrates the sole assembly in pieces showing (left to right) an upper (first) slab, a grommet, a plastic plate (the second plate), a lower (second) slab and a piece of the original outsole, which will be adhered to retain the original tread surface.

FIG. 5 illustrates the sole assembly in pieces showing (left to right) an upper (first) slab 505, a grommet 515, a plastic plate (or the second plate) 520, a lower (second) slab 525 and a piece of an outsole 530, this outsole piece can be specially manufactured for application to the mechanism which will be adhered to retain the original tread surface.

Figure 6:
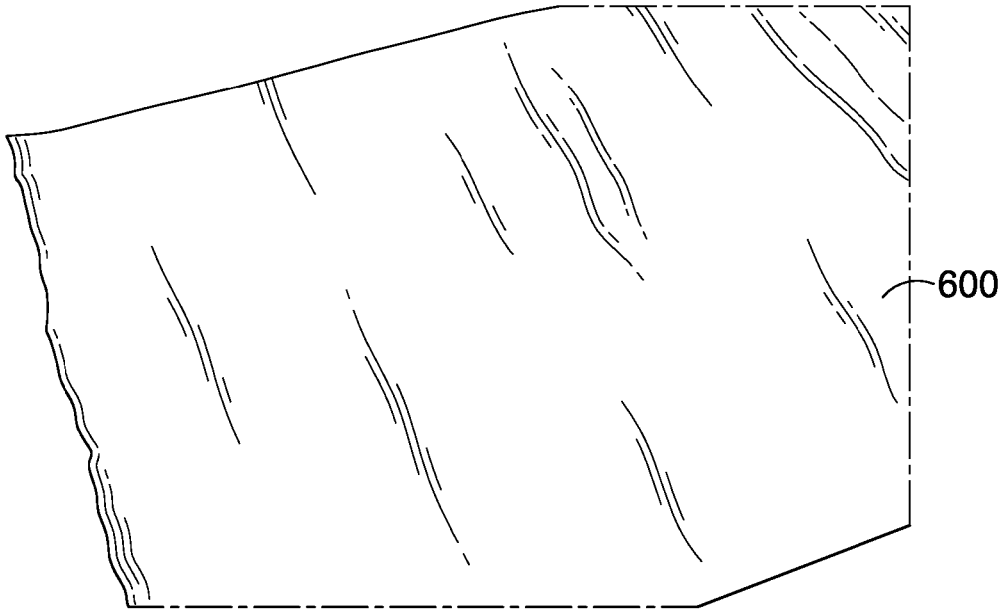
FIG. 6 illustrates an elastic material used in the sole assembly.

In embodiments, once the graphite lubricant has been applied to each plastic plate, the two halves of the sole assembly (Torc mechanism) are mated together ready to be bound by a "bumper" of strong elastic of the sort for example used for aerobic training. Such an elastic material 600 is shown in FIG. 6.

Figure 7:
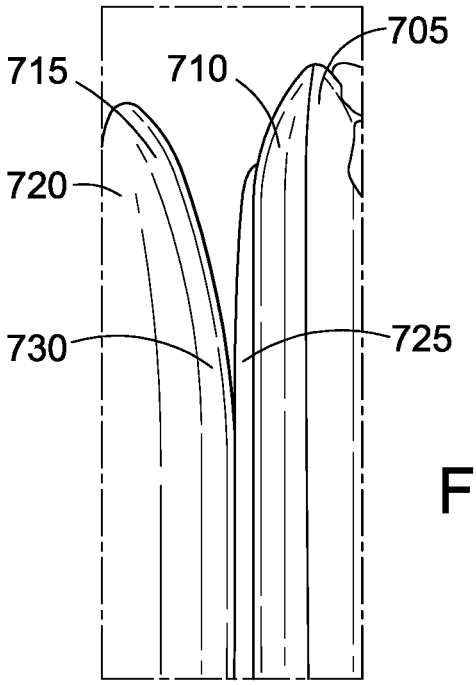
FIG. 7 illustrates a side view of the sole assembly having chamfered slabs.

FIG. 7 illustrates a side view of the sole assembly having chamfered slabs. In this embodiment, the first upper slab 720 has an edge 715 which is closest to the first plate 730. Similarly, the second lower slab 705 has an edge 710 which is closest to the second plate 725. The edges 710, 715 closest to the plates 725, 730 of both the first slab (EVA) 720 at the top of the assembly and the second slab (EVA) 705 at the bottom of the assembly are cut with a chamfer. The lower edge 715 of the first upper (blue) EVA 720 is chamfered inwards, and the upper edge 710 of the lower (second) EVA 705 is also chamfered inwards. Thus when placed together the chamfered edges 710, 715 form a groove in the middle of the perimeter of the midsole assembly (mechanism). The elastic bumper or material (not shown in FIG. 7) is then cut to shape, adhered to the assembly at one end, wrapped tightly around it under tension before being adhered at the other end.

Figure 8:
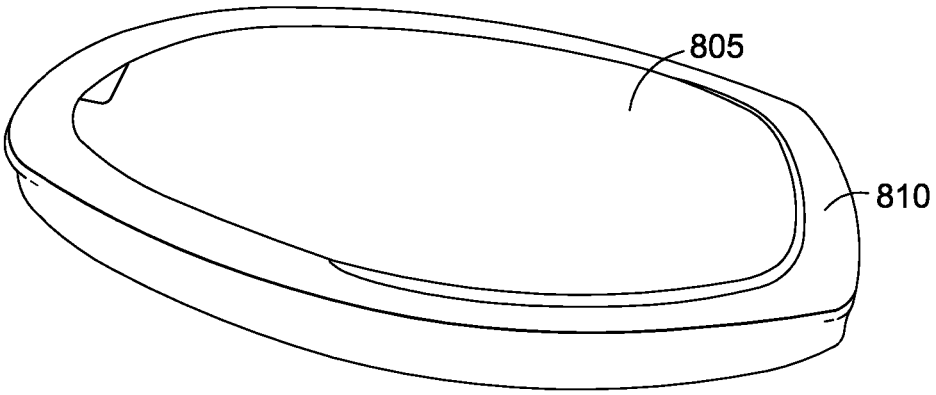
FIG. 8 illustrates an assembled midsole accordingly to an embodiment of the present invention.

FIG. 8 illustrates an assembled midsole assembly accordingly to an embodiment of the present invention. The end result is that the assembly is encapsulated by an elastic material (elastic bumper) 810, which holds the top section and the bottom section (second section) 805 together whilst still permitting (and controlling) their rotation relative to one another. This then forms the complete midsole assembly or the rotation mechanism, ready to be fitted to the host footwear.

It would be appreciated that, in one embodiment, the elastic material (rand) that runs around the perimeter of the slabs is stretched around the two slab (EVA) sections so that it encloses them, making a sealed unit. In one example, a relatively weaker grade of aerobic elastic material can be used, to create a rotational unit with a reduced torque resistance. This should allow the sole mechanism to engage easily. It would be appreciated that different grades of aerobic elastic material can also be used.

In one example, super glue (cyanoacrylate) can be used as an adhesive to adhere both the elastic material (rand) to the EVA sections and also to adhere the EVA sections to the plastic plates and the rest of the sole assembly. However, other types of adhesive materials can also be used and thus the invention is not restricted to the use of super glue. For example, 6090 type adhesive can be used for adhering the whole rotating unit to the sole of the shoe.

We now describe a series of test or experimental results achieved for the sole assembly installed in a shoe as described herein before.

Testing

To measure torque forces, a force platform has been used, this is able to measure dynamic torque forces transmitted from the footwear and directly relates to the torque forces in the lower leg.

Pedatron

The Pedatron is a walking simulator that recreates the forces of an average human gait using a combination of dead mass, pneumatics and prosthetic foot forms. The forces are not only in vertical loading but also horizontal forces and torque.

A feature of the Pedatron is the ability to rotate the "floor" by an exact angle between each stride, thus creating rotational torque in the leg as per a human subject making a change in direction. This rotational angle remains the same for any footwear; the footwear is forced to rotate until friction between the shoe sole and the floor surface is overcome and the shoe slips (torsional slip).

This flooring surface can be replaced with a force platform. This is normally done for calibration reasons but in this case, gives a very practical way of determining the torsional forces during the rotational of the floor. These forces will be dependent on the ability of the footwear to resist torsion through shear forces building up in the sole unit and the tread/sole materials ability to grip the surface. Typically as the floor rotates, torsional forces build to a peak at which point the sole is no longer able to grip, friction is overcome and torsional slip occurs.

Interpretation of Force Platform Data

We will now describe how the data gathered by the force platform relates to human gait and the operation of the Pedatron.

The force platform has 4 triaxial sensors capable of measuring force in all three axes. These measurements can be combined by the software to give torsional values. For simplicity, measurements here are moments about the vertical axis.

As the machine walks, the vertical force graph can be captured. As the machine gait is carefully controlled and repeatable, the vertical force graphs can be used to accurately superimpose the results from different footwear. This means that when traces from vertical force recordings are viewed together, the key points from the gait cycle align, allowing for the graphs to be superimposed and the forces compared.

Figure 9:
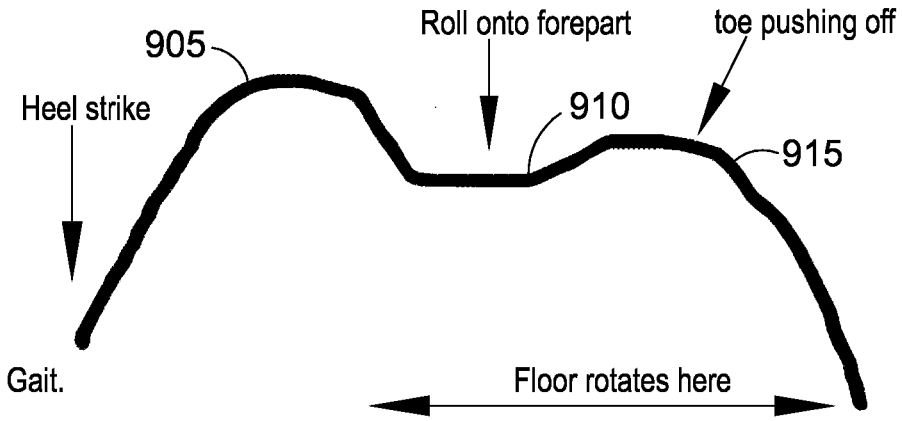
FIG. 9 illustrates an idealised representation of the vertical force trace of a typical human gait.

FIG. 9 illustrates an idealised representation of the vertical force trace of a typical human gait. It is annotated with the key physical features of gait. In this example, the user does not wear a shoe having the rotatable sole assembly described above. As can be seen in FIG. 9, the magnitude of the vertical force is relatively high at the first region 905 of the graph where the heel of the user strikes the floor. The vertical force reduces in the subsequent section 910 when the toe of the user moves towards the floor. As soon as the toe strikes the floor (the toe pushing off action) the vertical force increases again as seen in the final section 915 of the graph.

Figure 10:
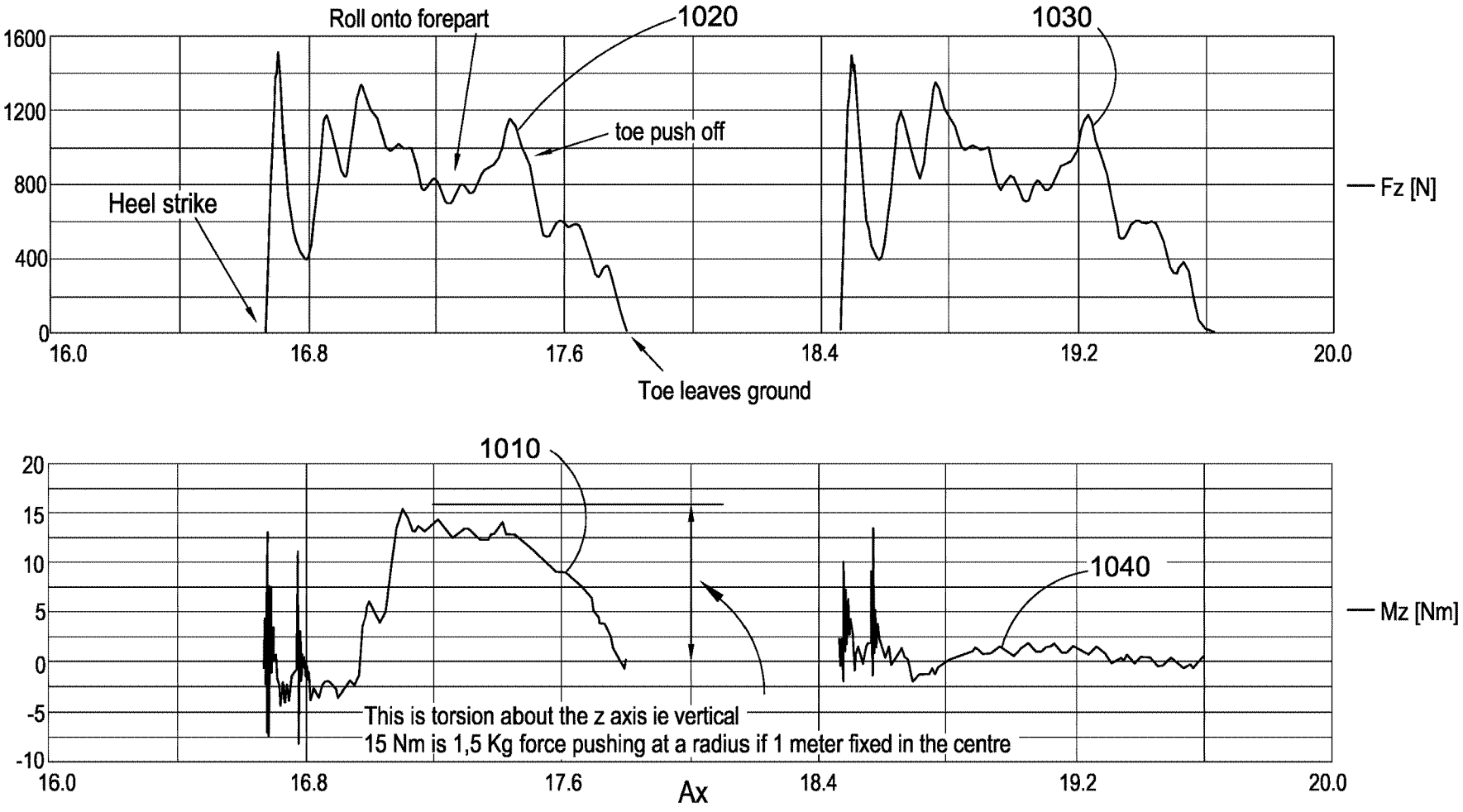
FIG. 10 illustrates experimental results showing 4 graphs in which the top left graph represents a vertical force in a first step with the sole assembly being rotated; the top right graph represents a vertical force in a second step in which the sole assembly does not rotate; the bottom left graph represents a torsional force in a first step with the sole assembly being rotated; the bottom right graph represents a torsional force in a second step in which the sole assembly does not rotate.

FIG. 10 illustrates experimental results showing 4 graphs in which the top left graph represents a vertical force in a first step with the sole assembly being rotated; the top right graph represents a vertical force in a second step in which the sole assembly does not rotate; the bottom left graph represents a torsional force in a first step with the sole assembly being rotated; the bottom right graph represents a torsional force in a second step in which the sole assembly does not rotate. FIG. 10 illustrates a typical trace/graph covering two full steps by the pedatron. The "floor" has been programmed to rotate about 15 degrees at every other step. The rotation is triggered shortly after the heel strike, during roll through and toe off.

In FIG. 10, the upper two traces or graphs 1020 and 1030 show the vertical forces of two consecutive steps. Graph 1020 represents the vertical forces for the first step and graph 1030 represents the vertical forces for the second step. In FIG. 10, the lower traces or graphs 1010, 1040 are the torsional forces about the vertical axis. The bottom left trace or graph 1010 shows the floor rotating inducing additional torsion. In the second step, the bottom right graph 1040, the floor is not rotating and so shows low torsional forces. It will be noted that the "spikes" are produced as a result of the heel strike on the machine and is a mechanical noise.

Force Plate Assessment

Force platform assessments have been carried out to measure torque (about the vertical axis) values when the shoes were tested in the Pedatron, with the default surface of the manufacturer force plate providing the test surface. The surface of the force plate has a mean British Pendulum Slip Value of 46, making it a suitably generic test surface.

The Pedatron has been fitted with a SACH artificial foot (right) of appropriate size, and set to walk for 10 steps. The rotation was left on, so that on every second step the floor indexed underneath the toe/forepart of the footwear, causing the activation of the shoe mechanism.

Tri-axial force data has been gathered and processed by the software and plotted on a graph. The torque trace/graph was then identified, and viewed in isolation.

In each case, a right shoe of each type has been tested. Each shoe was fitted to a "SACH" foot of suitable size, and set to undergo 10 steps in the Pedatron. The rotation of the test surface has been left on, so that on every alternate step a twisting motion has been applied to the sole of the footwear via this movement.

Three types of sample have been assessed in this way:

1. A non-modified shoe. This shoe provides the donor "chassis" that the shoe mechanism was built into. The footwear has an EVA midsole with a TR outsole.

2. A modified shoe with a blue rand (a first elastic material). The blue rand is the weaker of the two elastics that have been used.

3. A modified shoe with beige rand (a second elastic material). The beige rand is the most powerful elastic used so far. In other words, the elastic modulus of the second elastic material (beige rand) is higher than the elastic modulus of the first elastic material (blue rand).

Figure 11:
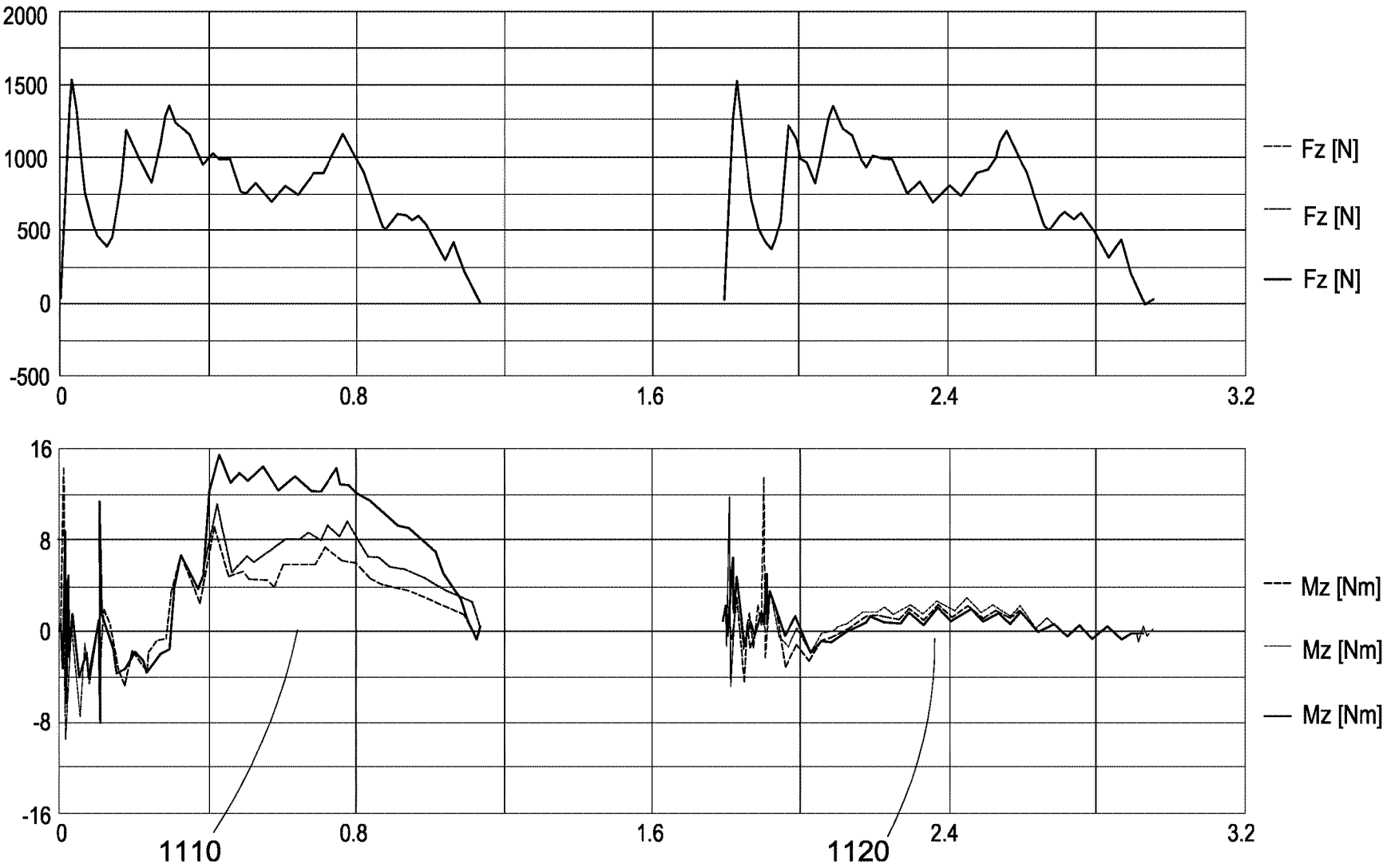
FIG. 11 illustrates 4 graphs representing vertical and torque forces for two consecutive steps using three different sole assemblies.
Figure 12:
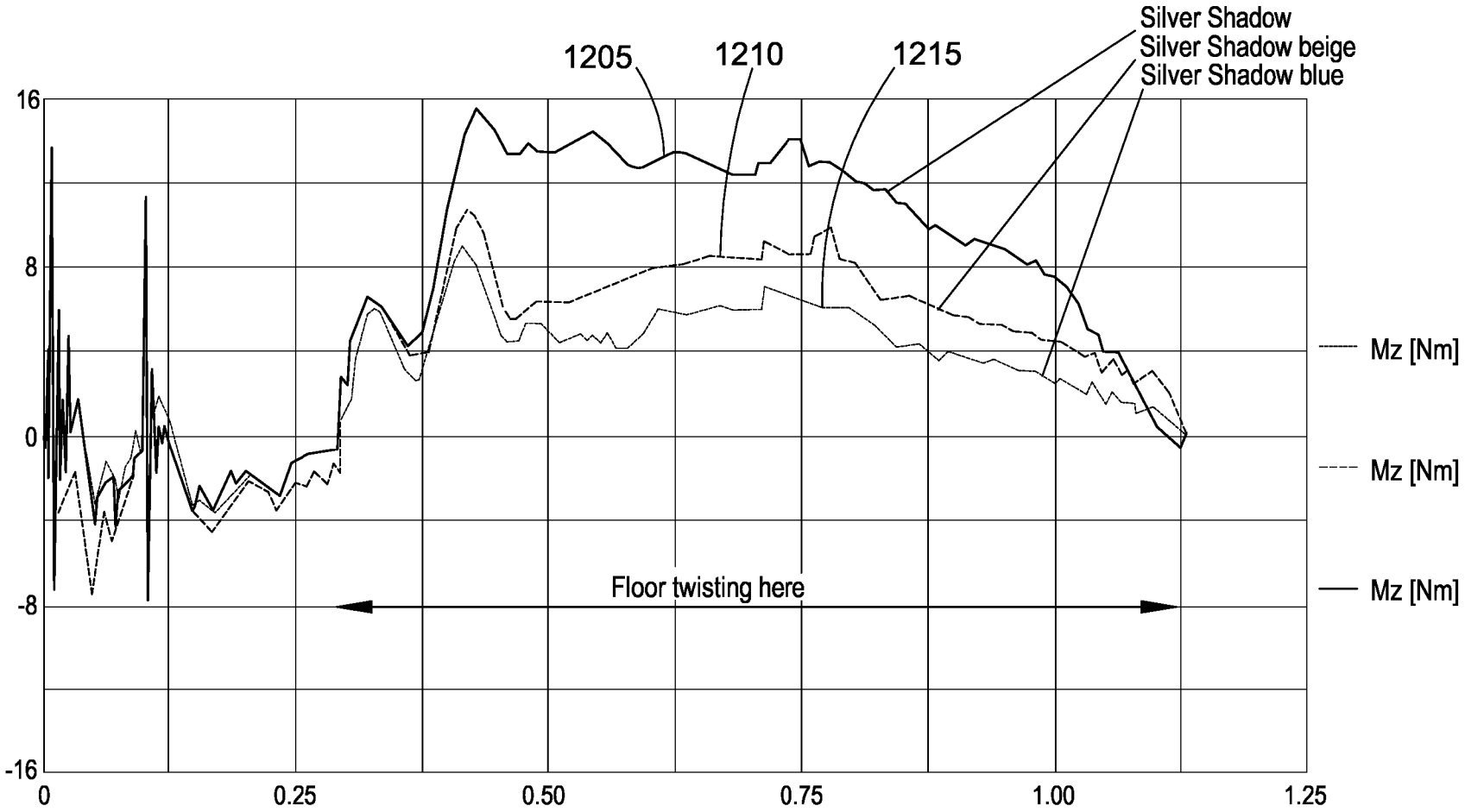
FIG. 12 illustrates the comparison of torque forces in three different shoes which is shown in the bottom left graph of FIG. 11.

FIG. 11 illustrates 4 graphs representing vertical and torque forces in which the top two graphs show vertical forces and the bottom two graphs show torque forces for two consecutive steps using three different sole assemblies. FIG. 12 illustrates the comparison of torque forces in three different shoes which is shown in the bottom left graph of FIG. 11. As can be seen in FIG. 12, the vertical traces almost exactly align showing that vertical forces are very nearly identical for the three shoes. This is also a good indicator the gait of the Pedatron is consistent.

In FIG. 11, the lower trace 1110 show the torsional forces about the vertical axis. The left hand trace is during a step where the floor is rotating, the right hand lower trace (graph) 1120 is where the floor is static. As can be seen the traces for each shoe when the floor is turning are very different, each shoe is transmitting the torsional force in different amounts.

Turning now to FIG. 12, graph 1205 represents the torque force variation of the un-modified shoe or footwear, graph 1210 represents the torque force variation of the shoe having the second elastic material (beige rand) and graph 1215 represents the torque force variation of the shoe having the first elastic material (blue rand). Approximate peak torque values read from the graphs are shown in the following table:

| | Force plate default surface PV = 46 |
|---|---|
| Un-modified footwear | 16 Nm |
| Footwear with beige rand (the second elastic material) | 10 Nm |
| Footwear with blue rand (the first elastic material) | 9 Nm |

It is therefore apparent that the torque force is reduced when the elastic material is used. It is also apparent that the torque force is in a relationship with the elastic modulus of the elastic material, i.e. the torque force increases with the increase of the elastic modulus of the elastic material.

Figure 13A:
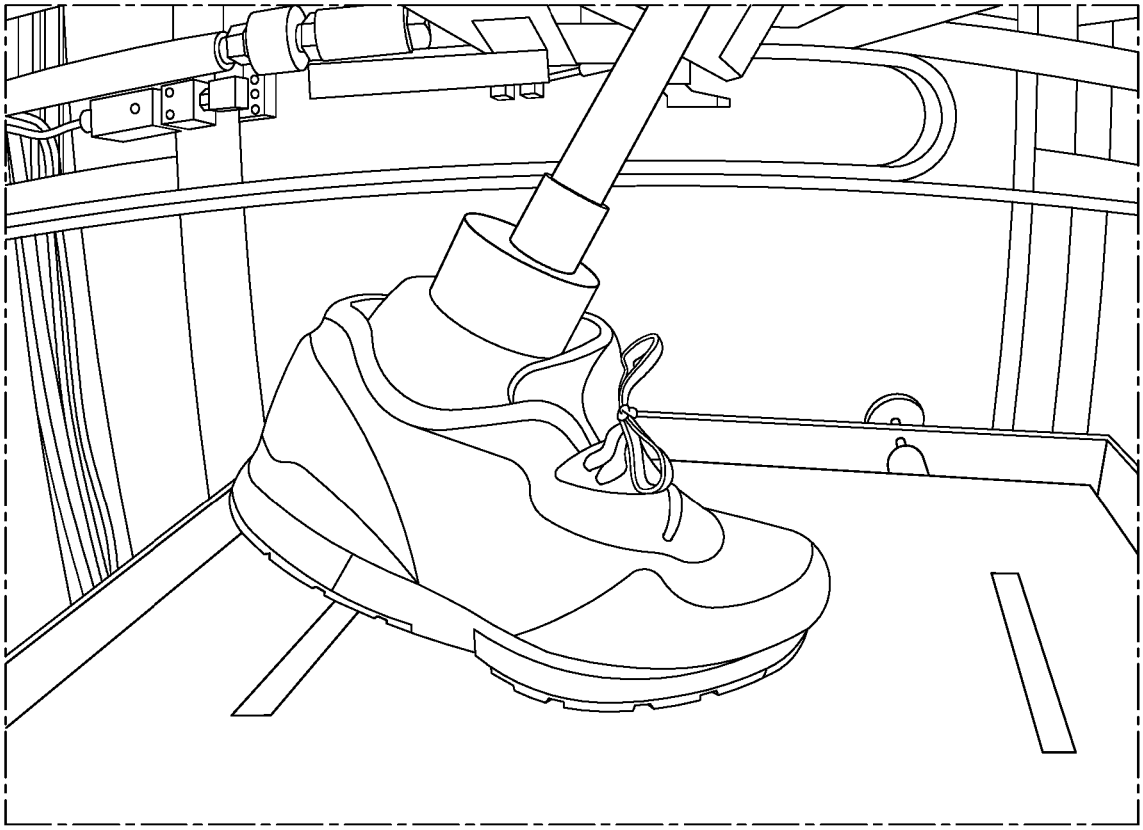
FIG. 13 (*a*) to FIG. 13 (*c*) show a shoe featuring the sole assembly comprising an elastic material pictured during laboratory testing.
Figure 13B:
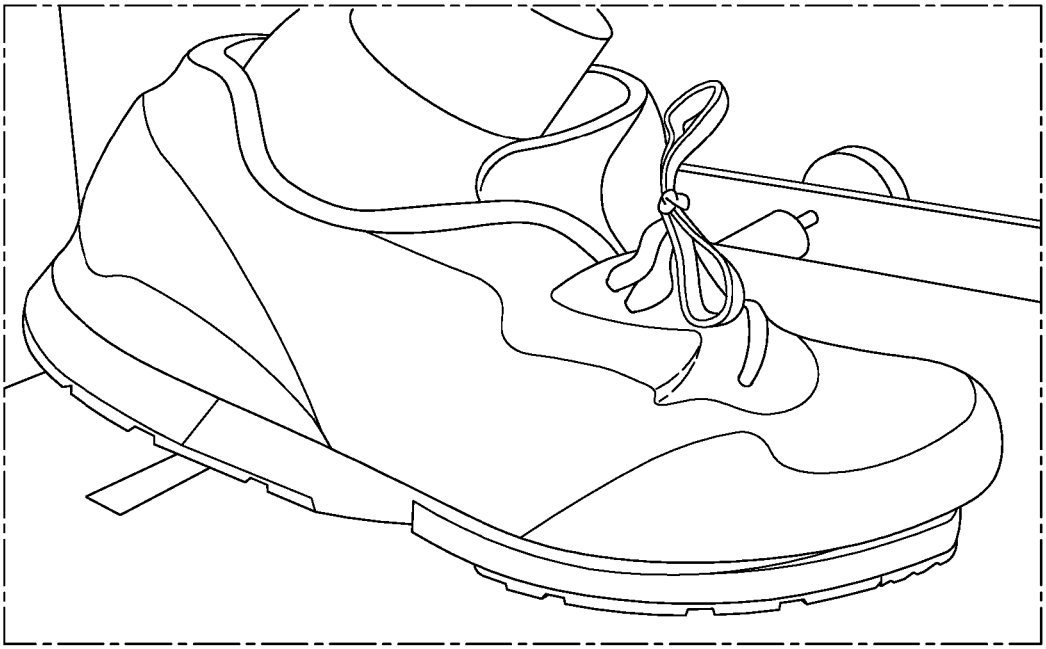
Figure 13C:
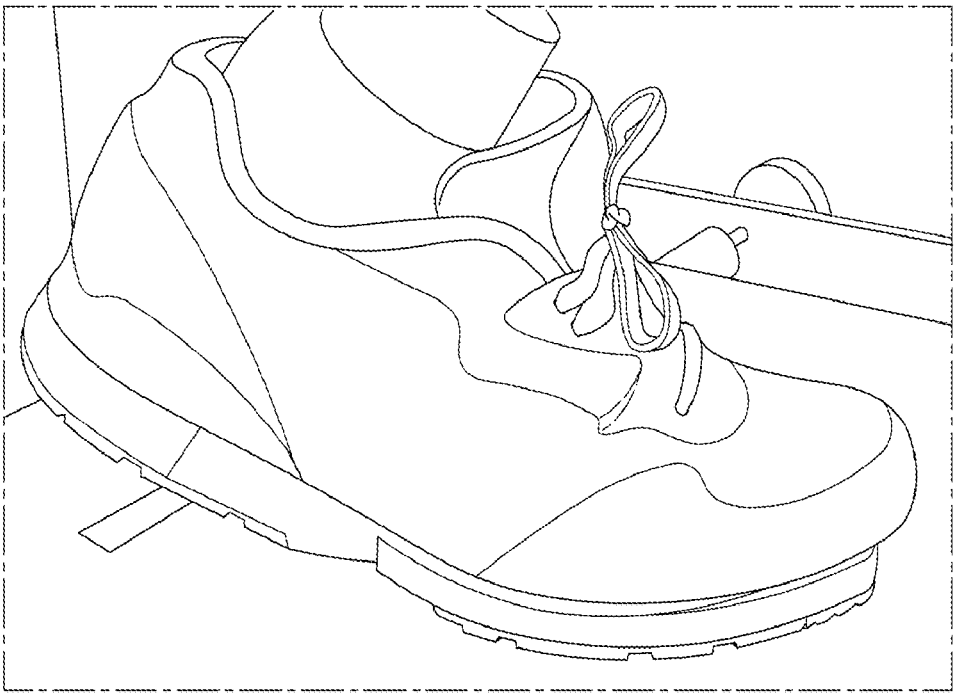

FIG. 13 (*a*) to FIG. 13 (*c*) show a shoe featuring the sole assembly comprising the beige elastic (the second elastic). In FIG. 13 (*a*), the shoe is positioned as the test surface is twisting anti-clockwise underneath it. In FIG. 13 (*b*), the shoe is positioned as the test surface is twisted anti-clockwise underneath it. In FIG. 13 (*c*), the shoe is positioned as the force platform begins to be rotated clockwise underneath the shoe.

Biomedical studies show that with forces of approximately 36 Nm, the probability of ligamentous damage of the knee including complete or partial ACL rupture is about 60%. Avulsion fractures occur at lower torques of about 30 Nm (30% probability). 17 Nm of torque is sufficient to create a turning moment that will twist the knee, even under a load of twice bodyweight. The proposed sole assembly is designed to reduce the overall torque experienced in the knee of an athlete or service personnel, and to ultimately avoid high levels that could cause or exacerbate injury.

Studded/cleated footwear and where sole patterns designed to give good performance on loose surfaces, dramatically reduce torsional slip greatly increasing the risk of ACL injury.

With the use of this proposed sole assembly torsional forces are buffered and rise gradually, not suddenly. There are clear inferences about improved sports performance. For example, golf swing; energy return when kicking a football; avoiding scuffs and ground damage on golf courses.

Torques reduction is in the order of 45% in these tests even when tested with a not particularly grippy surface on our force plate.

The system lends itself to a cassette construction which allows for customisation and replacability between left and right, for making footwear for people convalescing after hip injuries or for footwear aimed at performance sport or for handed sports like golf.

Torsional body movements require slip to occur reducing traction. This design means that traction is actually improved with the sole never actually breaking free and having to slip on the surface.

Although the invention has been described in terms of preferred embodiments as set forth above, it should be understood that these embodiments are illustrative only and that the claims are not limited to those embodiments. Those skilled in the art will be able to make modifications and alternatives in view of the disclosure which are contemplated as falling within the scope of the appended claims. Each feature disclosed or illustrated in the present specification may be incorporated in the invention, whether alone or in any appropriate combination with any other feature disclosed or illustrated herein.

The invention claimed is:

1. A rotatable sole assembly for a shoe, the sole assembly comprising:

a first plate;

a second plate; and a coating layer between the first and second plates;

wherein the coating layer is configured to rotate one of the first and second plates with respect to the other of the first and second plates, and wherein the rotatable sole assembly further comprises an elastic material holding the first and second plates to control a rotation of the sole assembly.

2. A sole assembly according to claim 1, being a midsole assembly which is coupled to a front end portion of the shoe and an outer sole portion of the shoe.

3. A sole assembly according to claim 1, wherein:

the coating layer comprises a lubricant material, wherein the lubricant material comprises graphite powder; or the coating layer is formed from the first and second plates; or the first and second plates comprises a material comprising polyethylene terephthalate.

4. A sole assembly according to claim 1, further comprising:

a first slab coupled to the first plate; and a second slab coupled to the second plate, wherein the first and second slabs are formed on sides of the first and second plates which are opposite to the sides of the first and second plates on which the coating layer is formed.

5. A sole assembly according to claim 4, wherein the first and second slabs comprise a material comprising EthylVinylAcetate (EVA).

6. A sole assembly according to claim 4, wherein the first and second plates each comprise a hole, further comprising:

a grommet which fits through the hole of each of the first and second plates, wherein the grommet is attached to the plates and slabs using an adhesive material comprising cyanoacrylate; and the grommet is a plastic grommet.

7. A sole assembly according to claim 4, wherein the elastic material is formed surrounding a perimeter of the plates and slabs, wherein:

the elastic material is configured to generate a force which permits each rotatable plate and slab to return to a centrally biased position, wherein the elastic material comprises an elastic modulus which is controlled to generate the force; and the elastic material is attached to the plates and slabs using an adhesive material comprising cyanoacrylate.

8. A sole assembly according to claim 1, wherein:

the first plate comprises a concave shape; and the second plate comprises a convex shape; and the sole assembly is coupled to the shoe and to an outer sole of the shoe by an adhesive material; and the sole assembly is configured to rotate at an angle of about 10° to 25° about a longitudinal axis of the sole assembly.

9. A rotatable shoe comprising:

a body portion;

the sole assembly according to claim 1; and an outer sole;

wherein the sole assembly is coupled to a front end portion of the body portion and the sole assembly is coupled to the outer sole, wherein the sole assembly is configured to reduce a torque applied to the front end portion of the body portion of the shoe.

10. A method of manufacturing a rotatable sole assembly for a shoe, the method comprising:

providing a first plate;

providing a second plate;

providing a coating layer between the first and second plates so that one of the first and second plates rotates with respect to the other of the first and second plates; and providing the rotatable sole assembly with an elastic material holding the first and second plates, to control a rotation of the sole assembly.

11. A method according to claim 10, wherein:

the sole assembly is a midsole assembly which is coupled to a front end portion of the shoe and an outer sole portion of the shoe; and the coating layer comprises a lubricant material comprising graphite powder; or further comprising deforming the coating layer from the first and second plates.

12. A method according to claim 10, further comprising:

providing a first slab on the first plate; and providing a second slab on the second plate, wherein the first and second slabs are provided on sides of the first and second plates which are opposite to the sides of the first and second plates on which the coating layer is formed;

wherein the first and second slabs comprise a material comprising EthylVinylAcetate (EVA).

13. A method according to claim 12, further comprising providing a grommet which fits through a hole of the first and second plates, further comprising attaching the grommet to the plates and slabs using an adhesive material comprising cyanoacrylate.

14. A method according to claim 12, further comprising attaching the sole assembly to the shoe and to an outer sole of the shoe by an adhesive material.

* * * * *